US006460738B1

(12) United States Patent
Petit

(10) Patent No.: US 6,460,738 B1
(45) Date of Patent: Oct. 8, 2002

(54) FLUID PRODUCT DISPENSING DEVICE

(75) Inventor: Ludovic Petit, Vitot (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 09/980,766

(22) PCT Filed: Jun. 5, 2000

(86) PCT No.: PCT/FR00/01536

§ 371 (c)(1),
(2), (4) Date: Dec. 6, 2001

(87) PCT Pub. No.: WO00/76675

PCT Pub. Date: Dec. 21, 2000

(30) Foreign Application Priority Data

Jun. 10, 1999 (FR) ..... 99 07312

(51) Int. Cl.[7] ..... B67D 5/58
(52) U.S. Cl. ..... 222/189.09; 222/321.2
(58) Field of Search ..... 222/189.09, 189.11, 222/321.2, 321.7, 321.9, 494

(56) References Cited

U.S. PATENT DOCUMENTS 4,228,931 A * 10/1980 Ruscitti et al. ..... 222/321.2
4,694,976 A * 9/1987 Schuetz ..... 222/189.09
5,190,192 A * 3/1993 Lina et al. ..... 222/321.2
5,316,198 A * 5/1994 Fuchs et al. ..... 222/321.2
5,894,963 A * 4/1999 Hirota ..... 222/321.2
5,927,559 A * 7/1999 Bommer et al. ..... 222/189.09
6,053,368 A * 4/2000 Geimer ..... 222/189.09

* cited by examiner

*Primary Examiner*—Joseph A. Kaufman
(74) *Attorney, Agent, or Firm*—Sughrue Mion, PLLC

(57) ABSTRACT

A fluid dispenser device has a fluid reservoir (10) and a dispensing member (20), such as a pump, actuated by an actuating rod (5) that is connected to a dispenser head (30) to dispense fluid selectively. The dispensing member is fixed to the reservoir by a fixing element (40), the dispenser device being provided with an air vent (50) situated outside the reservoir and outside the fixing element, an air filter element (60, 75) being disposed in the vicinity of the air vent, outside the fixing element, and the filter element being held on or in the vicinity of the air vent by an outer member (70) fixed to the fixing element and/or to the reservoir. The outer member has a fixing portion (71) which is fixed to the fixing element of the dispenser device, and a flexible membrane portion connected in leaktight manner to the actuating rod and/or to a piece (35) of the dispenser head.

8 Claims, 5 Drawing Sheets

FLUID PRODUCT DISPENSING DEVICE

BACKGROUND OF THE INVENTION

The present invention relates to an improved dispenser device for dispensing a fluid, and in particular to such a device that eliminates any risk of the fluid contained in it being contaminated.

Contamination of the fluid contained in a dispenser device is a long-standing problem, and many solutions have been proposed to remedy it. The solution generally chosen consists in disposing a filter for filtering the incoming air that replaces the previously dispensed metered quantity of fluid. The filter is generally disposed at the vent hole of the pump, which makes it necessary to modify "standard" pumps that do not include such filters. Another solution has been to dispose the filter between the reservoir and the fixing ring for fixing the pump to the reservoir. That solution also makes it necessary to modify an element of the device, namely the fixing ring, which must firstly receive and hold the filter and secondly have a single opening acting as a vent hole. All of the solutions proposed until now have thus required modification of one or more component parts of the dispenser device in order to provide the function of filtering the incoming air.

Document U.S. Pat. No. 5,727,715 discloses a filter system that can be disposed outside the fixing ring of the pump on the reservoir. Sealing is implemented at the pump by means of an O-ring gasket disposed around the actuating rod of the pump. That implementation is complicated because it is relatively unreliable and risks hindering the actuating of the pump. The size of the O-ring gasket must be determined very accurately, which can be problematic.

SUMMARY OF THE INVENTION

An object of the present invention is to provide a fluid dispenser device that makes it possible to filter the incoming air, and that does not suffer from the above-mentioned drawbacks.

Another object of the present invention is to provide a fluid dispenser that makes it possible to filter the incoming air, that enables the air to be filtered without modifying the parts making up the device, and that is adaptable to fit all existing dispenser devices.

Another object of the present invention is to provide such a fluid dispenser device that makes it possible to filter the incoming air, that operates reliably and safely, and that is simple to manufacture and to assemble.

To these ends, the present invention provides a fluid dispenser device for dispensing a fluid, said device comprising a fluid reservoir and a dispensing member, such as a pump, actuated by an actuating rod that is connected to a dispenser head to dispense said fluid selectively, said dispensing member being fixed to said reservoir by means of a fixing element, the dispenser device being provided with an air vent situated outside the reservoir and outside the fixing element, an air filter element being disposed in the vicinity of said air vent, outside said fixing element, said filter element being held on or in the vicinity of the air vent by means of an outer member fixed to the fixing element and/or to the reservoir, said outer member comprising a fixing portion which is fixed to the fixing element of the dispenser device, and a flexible membrane portion connected in leak-tight manner to said actuating rod and/or to a piece of said dispenser head.

In a first embodiment of the invention, said filter element is an annular filter.

Advantageously, said outer member is provided with an opening disposed between said two portions, a filter being held by the outer member at said opening.

In a second embodiment of the invention, the filter element is an integral part of said outer member.

Advantageously, the filter element is said flexible membrane which is permeable to air and acts as a filter.

Advantageously, said outer member is snap-fastened to said fixing element.

Advantageously, the dispenser head is provided with closure means at the dispensing orifice, so that all of the outside air that comes into contact with the fluid contained in the dispenser device goes through the filter element, preventing any contamination of said fluid before the device is actuated, while it is being actuated, and after it has been actuated.

BRIEF DESCRIPTION OF THE DRAWINGS

Other characteristics and advantages of the present invention appear more clearly from the following detailed description of embodiments of the present invention, given by way of non-limiting example, and with reference to the accompanying drawings, in which.

DETAILED DESCRIPTION OF THE PREFERRED EMBODIMENTS

Figure 1:
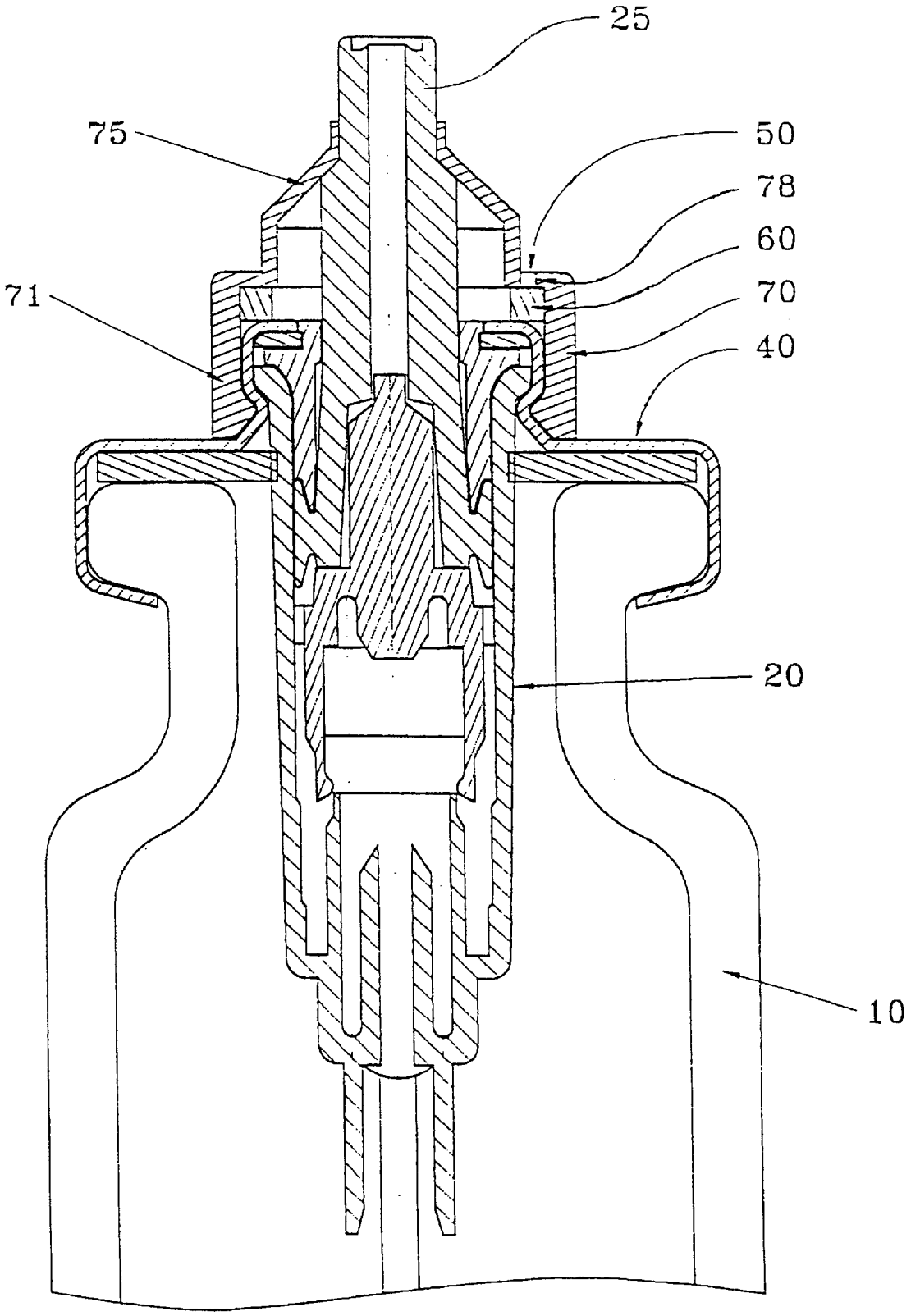
FIG. 1 is a diagrammatic section view of a portion of a fluid dispenser device in a first embodiment of the invention.

FIG. 1 is a fragmentary view of a fluid dispenser device comprising a reservoir 10 and a dispensing member, such as a pre-compression pump 20 as in this example, which is fixed to the reservoir 10 by means of a fixing element 40 (a crimped ring in this example). The reservoir, the pump, and the fixing ring may be of any known type, in particular of a standard type, and they are therefore not described in any more detail below.

In the invention, the device further comprises a filter element 60 or 75 for filtering the air entering the reservoir 10 to replace the metered quantity of fluid expelled when the device was last actuated. This incoming air passes through a vent hole 50 which, in the invention, is disposed outside the reservoir and outside the fixing element 40, and the filter element 60 or 75 is disposed in the vicinity of said vent hole 50.

In a first embodiment, shown in particular in FIG. 1, the filter element 60 is implemented in the form of an annular filter 60. The filter 60 is preferably held in the vicinity of the vent hole 50, outside the fixing ring 40, by an outer member 70 which can be fixed to the fixing element 40, in particular by snap-fastening as shown in FIG. 1. For this purpose, the outer member 70 comprises a fixing portion 71, constituted by snap-fastening means in this example, and a membrane portion 75 that is impermeable to air and that is fixed in leaktight manner to the actuating rod 25 of the pump 20.

Said outer member 70 is further provided with an opening 78 forming the vent hole 50, and against which the annular filter 60 is disposed. Advantageously, said filter 60 is held by the outer member 70 between said outer member and the outside of the fixing ring 40, at said opening 78. The membrane portion 75 is flexible so that it can be moved with the actuating rod 25 without there being any risk of leakage or loss of leaktightness where the outer member 70 meets the rod 25.

Figure 2:
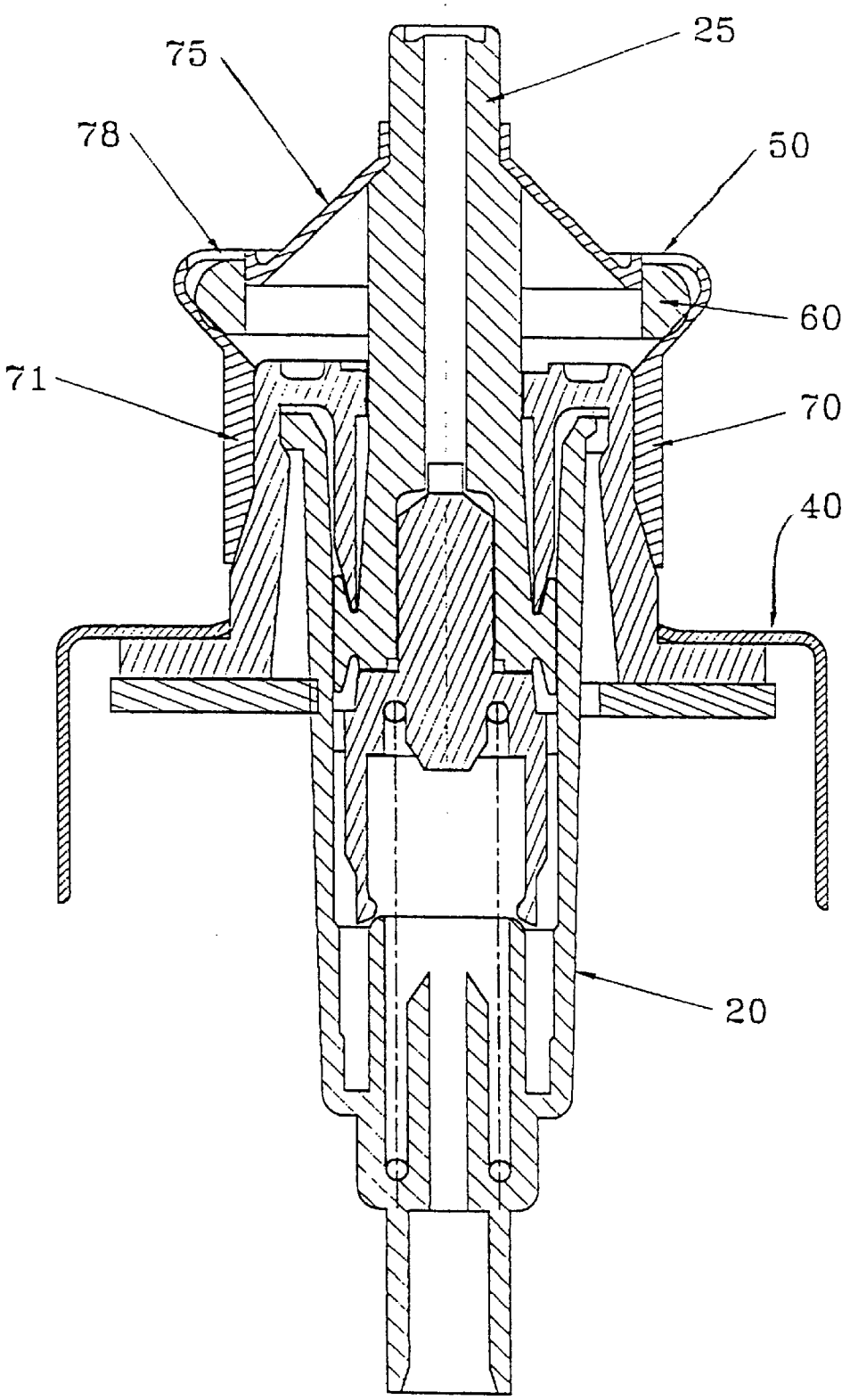
FIG. 2 is a view similar the FIG. 1 view, showing a variant of the first embodiment of the present invention.

FIG. 2 shows a variant of the first embodiment (shown in FIG. 1). In this variant, instead of being snap-fastened, the outer member 70 is fitted around the turret of a known pre-compression pump. Similarly, said outer member holds an annular filter 60 against an opening 78 forming the vent hole of the dispenser device. In this variant, the filter is held by the outer member 70 only, in an annular recess.

Figure 3:
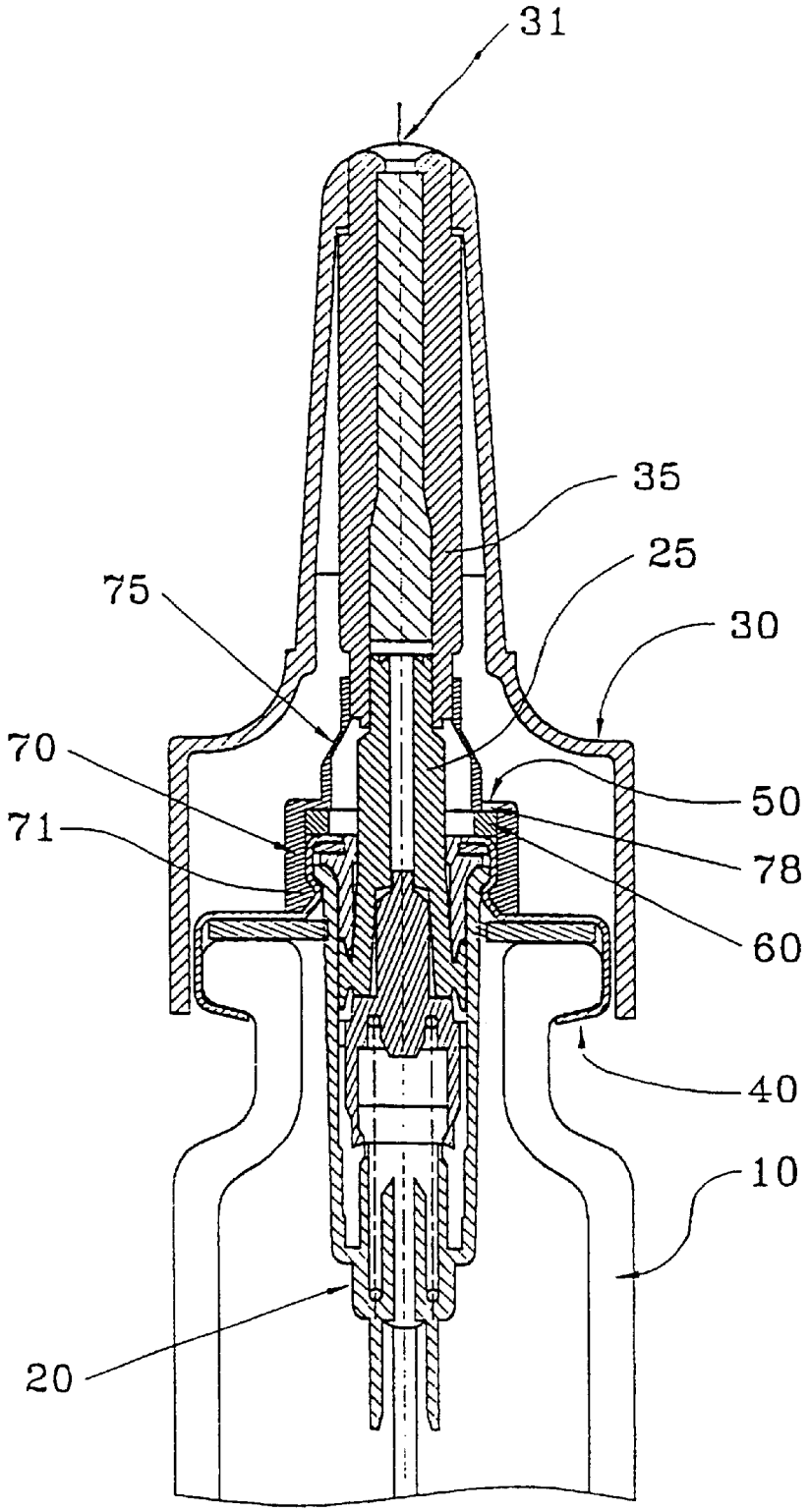
FIG. 3 is a diagrammatic section view of a device similar to the device of FIG. 1.

FIG. 3 shows another variant of the first embodiment, which variant is similar to the embodiment of FIG. 1. In this example, the dispenser had 30 is shown diagrammatically, and it advantageously comprises a structure in two pieces. Thus, the dispenser head includes a substantially tubular inner piece 35 defining a dispensing orifice 31, and which is fixed in leaktight manner to the actuating rod 25 of the pump. In which case, the flexible membrane portion 75 of the outer member 70 may be fixed to the inner piece 35 of the dispenser head rather than directly to the actuating rod 25, as shown in FIG. 1

Figure 4:
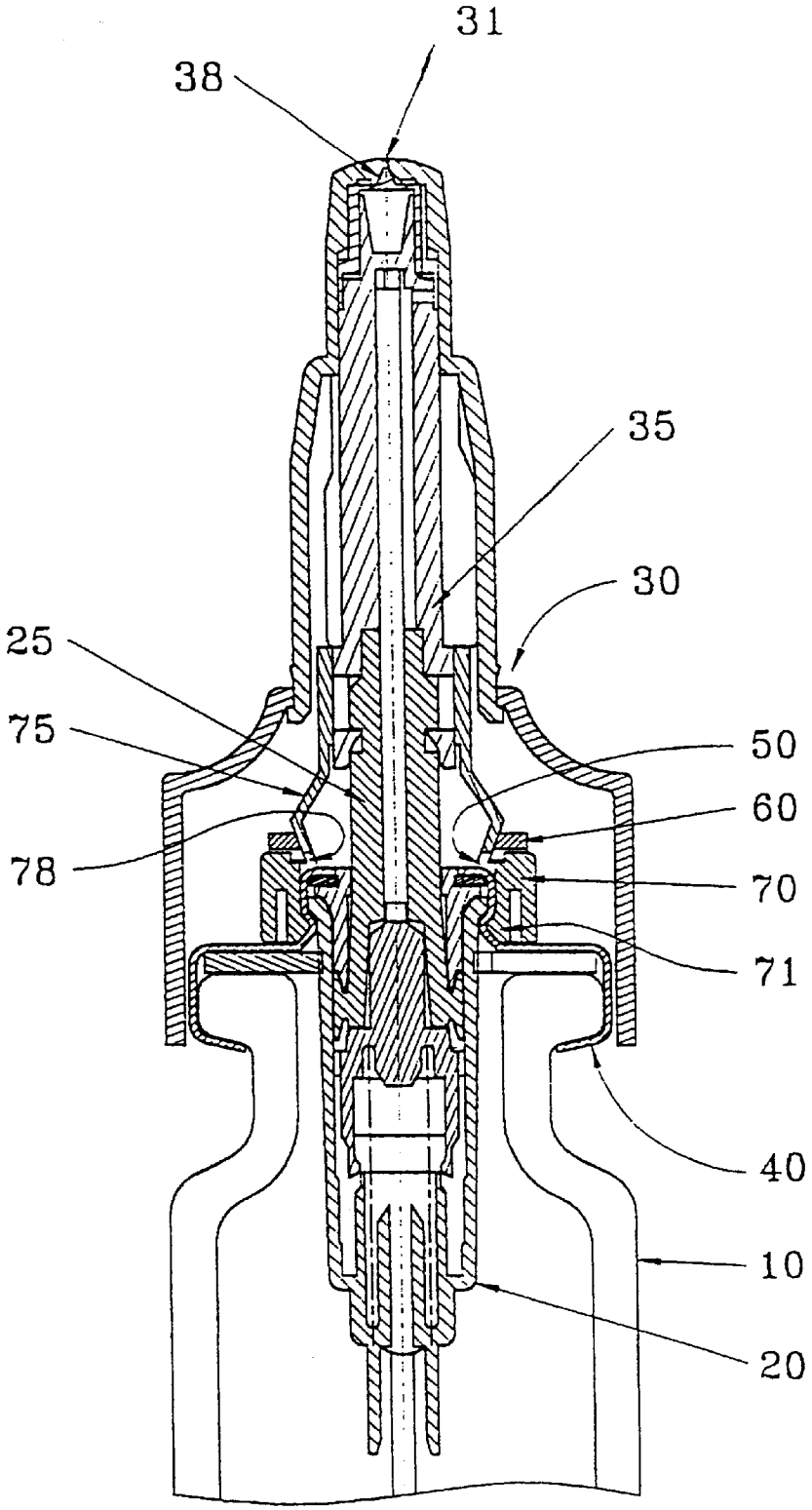
FIG. 4 is a diagrammatic section view of another variant of the first embodiment of the present invention.

FIG. 4 shows another variant of the first embodiment of the invention. In this variant, the outer member 70 holds the annular filter 60 on its out against its opening 78 forming the air vent hole 50 of the device. For this purpose, the outer ember 70 is advantageously provided with an annular radial recess into which said annular filter 60 is inserted from the outside. In this variant shown in FIG. 4, the dispenser head 30 is also shown as being made up of two pieces, but in a manner slightly different to the manner shown in FIG. 3. In this variant, the inner piece 35 is snap-fastened to the actuating rod 25 of the pump to prevent it from being torn off intentionally or accidentally. The membrane portion 75 of the outer member is also fixed in leaktight to said inner piece 35 of the dispenser head. In addition, in the example shown in FIG. 4, the dispenser head is provided with closure means 38 at the dispensing orifice 31, thereby guaranteeing total absence of contamination of the fluid contained in the device before, during, and after use thereof. In particular, the closure means prevent any air from entering via the dispensing orifice 31, the fact that the inner piece 35 of the dispenser head is fixed to the actuating rod 25 of the pump prevents the pump from being torn off, and therefore prevents contamination at said actuating rod 25, and the filter 60 filters the air that enters the device to replace the previously expelled metered quantity of fluid.

Figure 5:
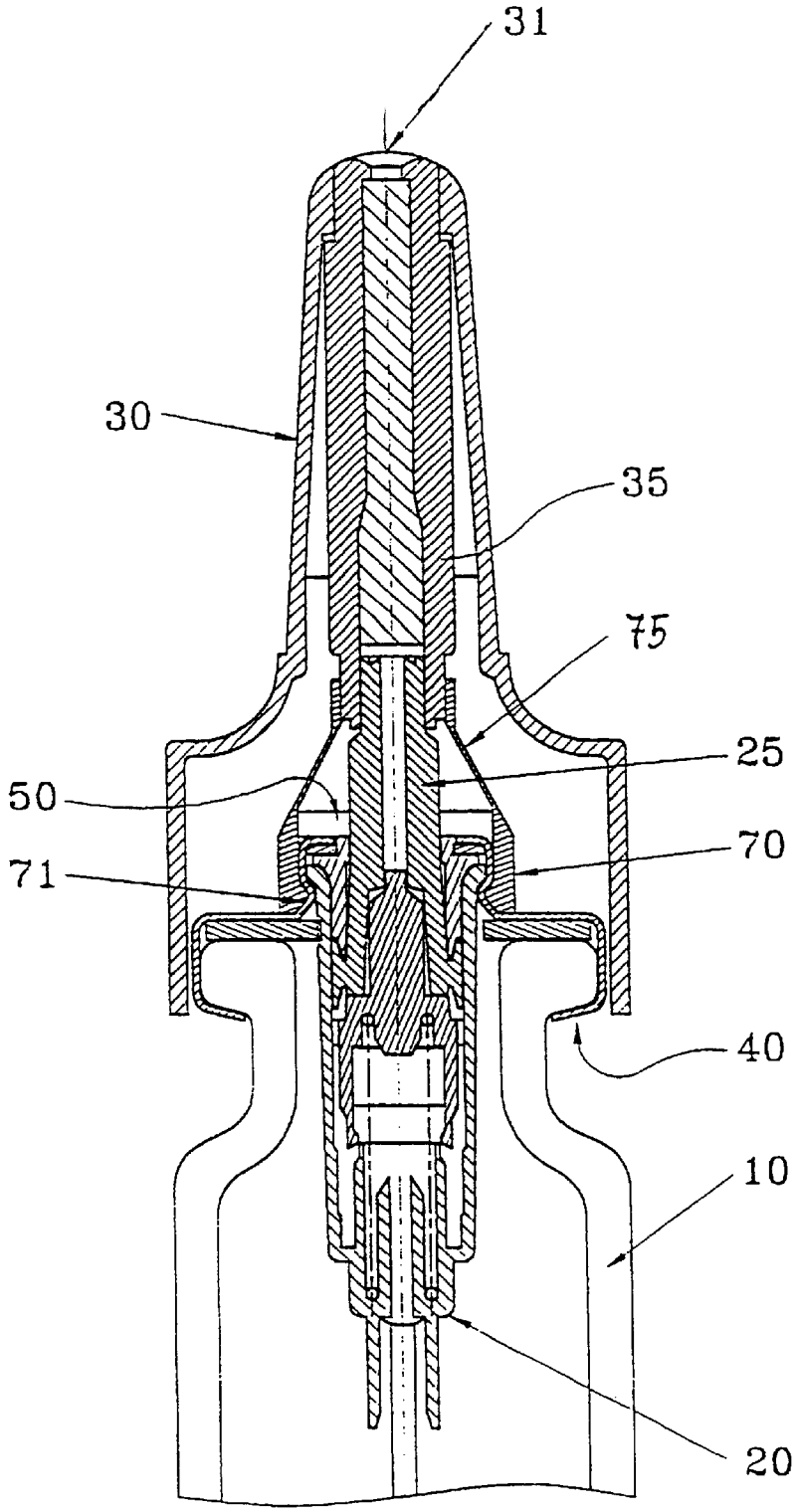
FIG. 5 is a section view of a fluid dispenser device in a second embodiment of the present invention.

FIG. 5 shows a second embodiment of the present invention. Overall, the dispenser device is similar to the device shown in FIG. 3, but the outer member 70 has a filtering flexible membrane portion 75 acting as the filter element for the device. For this purpose, said flexible membrane portion 75 is made of a suitable material that allows air to pass through it while filtering out the microbes, bacteria, and other contaminating agents. Said membrane 75 is fixed in leaktight manner to the inner piece 35 of the dispenser head, but it could equally well be fixed directly to the actuating rod 25 of the pump.

The two embodiments and the variants are described with reference to the drawings, and it is understood that the various variants can be combined in any manner. Similarly, although shown with a dispenser head in two pieces, the present invention is equally applicable to one-piece dispenser heads, and in general to all known dispenser heads. In addition, the dispensing member which, in the examples described is in the form of a pre-compression pump, may naturally equally well be made in any other manner.

What is claimed is:

1. A fluid dispenser device for dispensing a fluid, said device comprising a fluid reservoir (10) and a dispensing member (20) actuated by an actuating rod (25) connected to a dispenser head (30) to dispense said fluid selectively, said dispensing member being fixed to said reservoir by a fixing element (40), the dispenser device having an air vent (50) situated outside the reservoir and outside the fixing element, an air filter element (60) disposed in the vicinity of said air vent, outside said fixing element, said filter element being held on or in the vicinity of the air vent by an outer member (70) fixed to one of the fixing element and the reservoir, herein said outer member comprises a fixing portion (71) fixed to the fixing element of the dispenser device, and a flexible membrane portion (75) fixed in leaktight manner directly to one of said actuating rod and a piece (35) of said dispenser head.

2. A device according to claim 1, in which said filter element is an annular filter.

3. A device according to claim 1, in which said outer member is provided with an opening (78) disposed between said two portions (71, 75), said filter element being held by the outer member at said opening.

4. A device according to claim 1, in which the filter element is an integral part of said outer member.

5. A device according to claim 1, in which the filter element is said flexible membrane which is permeable to air and acts as a filter.

6. A device according to claim 1, in which said outer member is snap-fastened to said fixing element.

7. A device according to claim 1, in which the dispenser head has closure means (38) which prevents any air from entering via a dispensing orifice (31), so that all of the outside air that comes into contact with the fluid contained in the dispenser device goes through the filter element, preventing any contamination of said fluid before the device is actuated, while it is being actuated, and after it has been actuated.

8. The device according to claim 1, wherein said dispensing member is a pump.

* * * * *